United States Patent [19]

da Silva Pinto

[11] Patent Number: 4,494,469

[45] Date of Patent: Jan. 22, 1985

[54] STEPPED GRATE FOR AN INCINERATOR PLANT

[75] Inventor: Gabriel da Silva Pinto, Glostrup, Denmark

[73] Assignee: Volund Miljoteknik A/S, Denmark

[21] Appl. No.: 491,396

[22] Filed: May 4, 1983

[30] Foreign Application Priority Data

May 13, 1982 [GB] United Kingdom ..... 8213940

[51] Int. Cl.[3] ..... F23H 7/08; F23H 7/14

[52] U.S. Cl. ..... 110/281; 110/255; 110/328

[58] Field of Search ..... 110/268, 281, 282, 278, 110/327, 328, 255; 414/150, 156

[56] References Cited

U.S. PATENT DOCUMENTS

| | | | |
|---|---|---|---|
| 981,408 | 1/1911 | Fortune et al. | 110/281 |
| 1,607,914 | 11/1926 | Riley | 110/282 |
| 3,413,938 | 12/1968 | Dvirka | 110/281 |
| 4,170,183 | 10/1979 | Cross | 110/281 |
| 4,235,172 | 11/1980 | Martin et al. | 110/281 |
| 4,239,029 | 12/1980 | Martin et al. | 110/281 |
| 4,246,851 | 1/1981 | Bergh | 110/281 |
| 4,320,710 | 3/1982 | Steiner et al. | 110/281 |

FOREIGN PATENT DOCUMENTS

| | | |
|---|---|---|
| 1213703 | 11/1970 | United Kingdom . |
| 1412609 | 11/1975 | United Kingdom . |

*Primary Examiner*—Edward G. Favors
*Assistant Examiner*—Steven E. Warner
*Attorney, Agent, or Firm*—Fidelman, Wollfe & Waldron

[57] ABSTRACT

A stepped grate for an incinerator plant consists of grate blocks (1) placed adjacent in rows, and placed in succession in the travelling direction of the refuse and garbage resting on parallel placed grate beams (9), where every second row of grate blocks (1) is adapted to make a reciprocating movement, whereas the intermediary rows of grate blocks are stationary. The movable and the stationary rows of grate blocks (1) are placed in staggered position in the travelling direction of the garbage at a distance corresponding to half the length of a grate block, the one type of rows being terminated with half grate blocks (8). Preferably, it is the stationary row that is terminated with half blocks (8). The displacement of the rows of grate blocks removes the danger of blocking the movable row of grate blocks caused by collision between the front edge of a grate block from the movable row and the rear edge of a grate block from the stationary row.

3 Claims, 5 Drawing Figures

STEPPED GRATE FOR AN INCINERATOR PLANT

This invention relates to a stepped grate for an incinerator plant consisting of grate blocks placed in rows adjacent each other and in succession in the advance direction of the garbage and resting on parallel placed grate beams, in which every second row of grate blocks are adapted to make a reciprocating movement, while the intermediary rows of grate blocks are stationary.

In combustion of city and industrial refuse and garbage it has been known for a long time to use an incinerator plant the basic elements of which are constructed of a number, preferably three, of slightly forwards inclining stepped grates in succession, that are placed under the supply shaft of the incinerator plant and spaced apart a certain distance in the travelling direction of the garbage. On the first stepped grate a whirling up and a forward conveyance of the garbage occurs as well as an initial drying. On the following grate the garbage is further dried and an ignition occurs. On the third and last grate an initial combustion of the dried and ignited garbage takes place, after which the complete combustion takes place in the succeeding revolving furnace.

The individual stepped grates are constructed of a large number of grate blocks that consist of two parallel placed side boards which are connected with each other by transverse tie rods. The space between the two side boards is filled by grate bars loosely placed over the tie rods, which bars are placed easily removable side by side in the transversal direction of the grate blocks and in two transverse rows in succession. The individual grate blocks are placed in succession in the travelling direction and secured to the underlying grate beams by means of a loose bolt connection. Every second set of grate beams is connected with a reversibly rotatable drive shaft, whereas the intermediary sets of grate beams are stationary.

In the plants hitherto known the grate blocks of the stationary rows have been placed in flush with the grate blocks of the reciprocating rows of grate blocks when in rest position, and thereby the movable rows of grate blocks have moved from a position, in which the grate blocks from the one kind of rows are in flush with the grate blocks of the other kind of rows, to a position, in which the movable grate blocks are staggered a distance corresponding to about half the length of a block in the travelling direction of the garbage.

It has become apparent that this construction has a bad function, especially when starting the movable rows of grate blocks after a rest period. This is due to the fact that the relatively strongly heated (up to 1000° C.) grate blocks, which are not cooled off in a rest period, expand so much that the front end of the blocks in the movable row bump against the rear part of the fixed block in the adjacent row of stationary grate blocks, and thereby the forward drive of the movable grate blocks is totally stopped or considerably hindered, possibly accompanied by damage of the grate blocks in the form of corners knocked off or cracks in the side boards.

It is an object of the invention to provide a stepped grate which essentially is constructed in the same way as the hitherto known stepped grate, that is, by using the same basic components, but in which the disadvantages pointed out above are removed.

This object is achieved according to the invention in a stepped grate of the type mentioned in the introduction and characterized in that the movable and the stationary rows of grate blocks are placed in staggered position in the travelling direction of the garbage a distance corresponding to half the length of a grate block, as the one type of rows terminates at the middle of grate blocks.

By this it is achieved that the movable row of grate blocks can reciprocate in relation to the stationary row of grate blocks without danger of collision between the end edges of the grate blocks, as the front end of a grate block in the movable row will only reach to about the middle of the adjacent grate block in the fixed row of grate blocks.

In a preferred embodiment of a stepped grate according to the invention the rows of stationary grate blocks terminate at half blocks.

Thereby a possibility is achieved of using the same type of grate beams for supporting both the movable and the stationary grate blocks as in the hitherto known plants, because the displacement of the half grate block length can be done with no problems on the stationary grate beams.

In the following the invention is explained further with reference to the drawing, in which FIG. 1 shows a vertical section through three succeeding stepped grates of an incinerator plant, FIG. 2 a cross section of a stepped grate FIG. 3 an inclined view of a grate block FIG. 4 a row of succeeding grate blocks placed on stationary grate beams, and FIG. 5 a row of succeeding grate blocks placed on movable grate beams.

In FIG. 1 is shown a grate section consisting of three inclined stepped grates of an incinerator plant known per se. The individual stepped grates are constructed in the same way, in principle, as they consist of a number of grate blocks in succession in a row, said blocks supported by grate beams 2 placed parallel under the grate blocks 1. On the drawing is indicated schematically a hydraulic system for driving the grate beams.

FIG. 2 of the drawing shows a cross section through a stepped grate section from which it appears more clearly that every second row of grate blocks are placed stationary, while the intermediary rows are adapted to reciprocating movement, as they are connected with a drive shaft 3, which provides the reversible rotation, as the crank arm 4 shown at the left in the figure is connected with a double-acting hydraulic cylinder (not shown).

FIG. 3 shows a more detailed embodiment of the grate blocks 1 serving as a basic element. The grate blocks 1 consist of two side boards 5 placed parallel to each other, and between which transverse tie rods 6 are placed. A number of grate bars 7 are placed loosely over the transverse tie rods 6, which bars together fill the space between the two parallel side boards 5.

The block shown in FIG. 3 is a so-called whole block.

FIG. 4 shows a vertical section through a stationary row of grate blocks, and from which it appears that half grate blocks 8 are placed at the ends, as for the sake of clearness only part of the whole blocks are sketched in.

Figure 1:
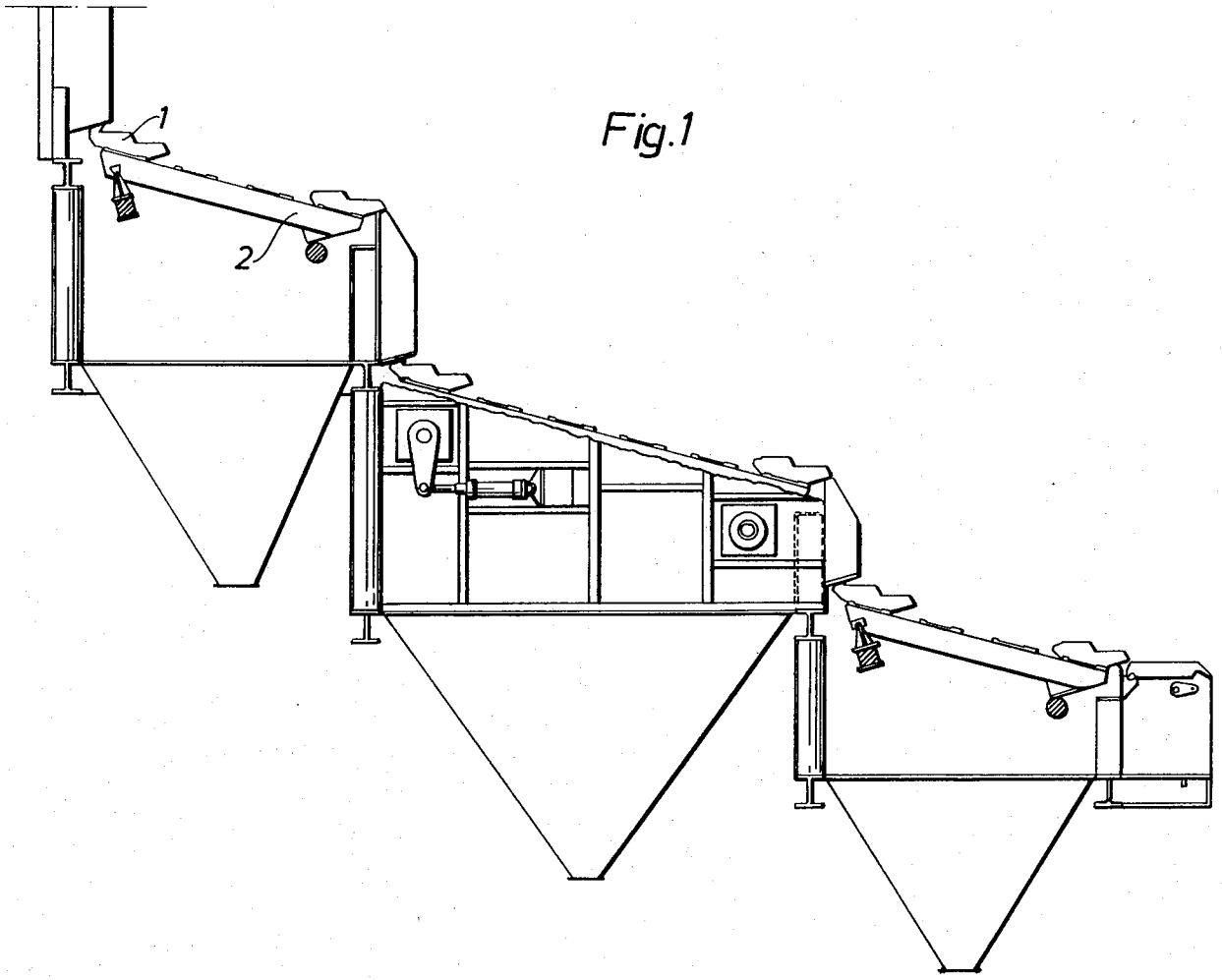
Figure 2:
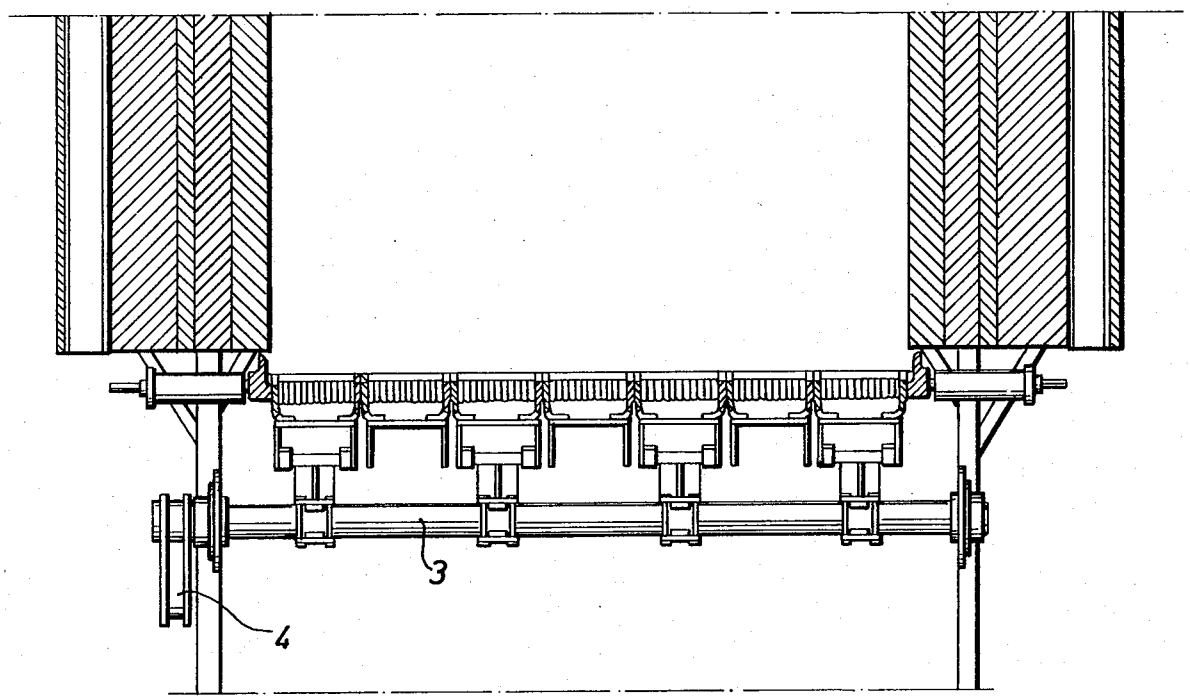
Figure 3:
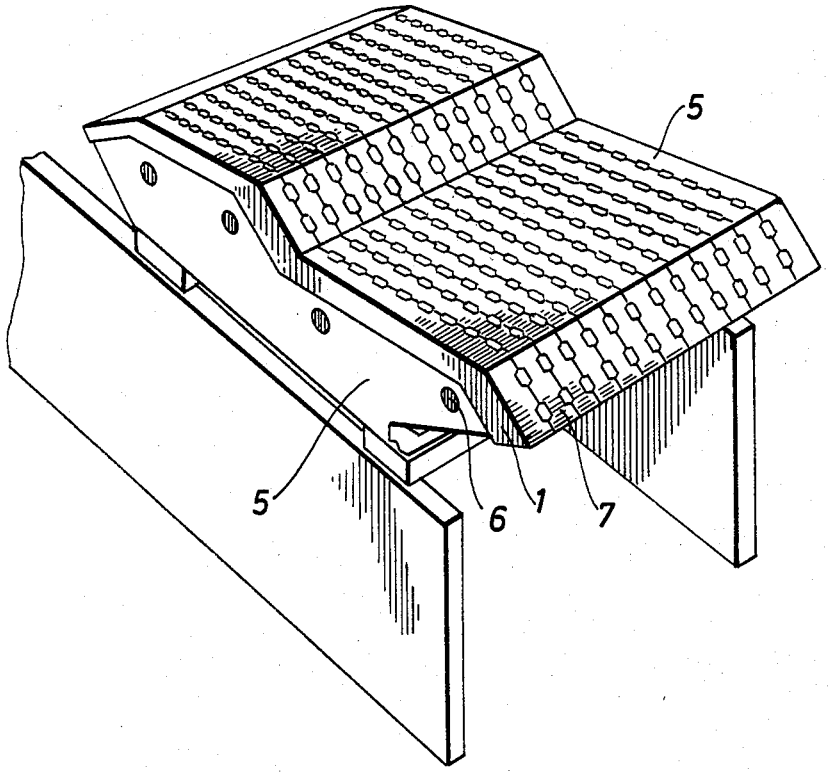
Figure 4:
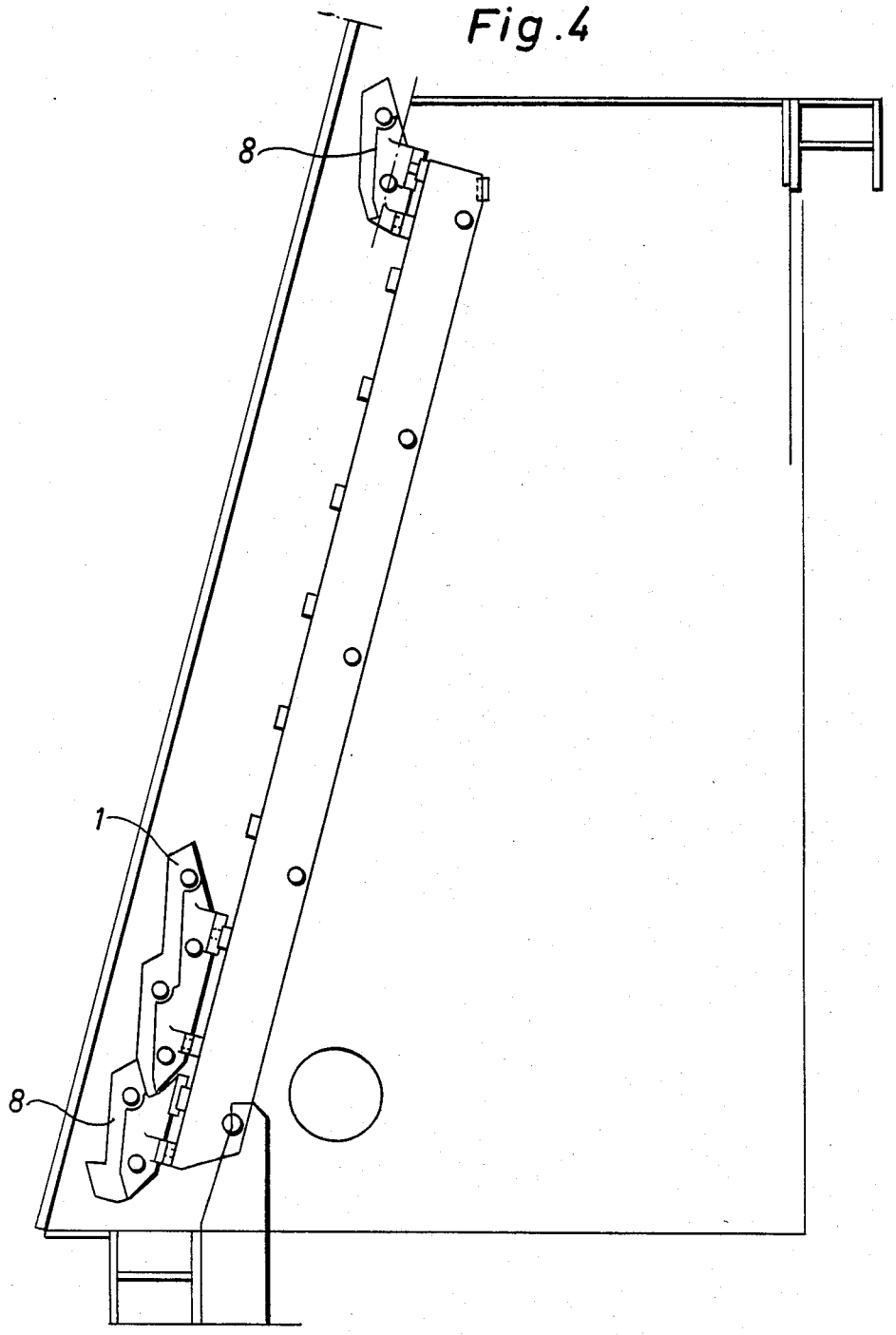
Figure 5:
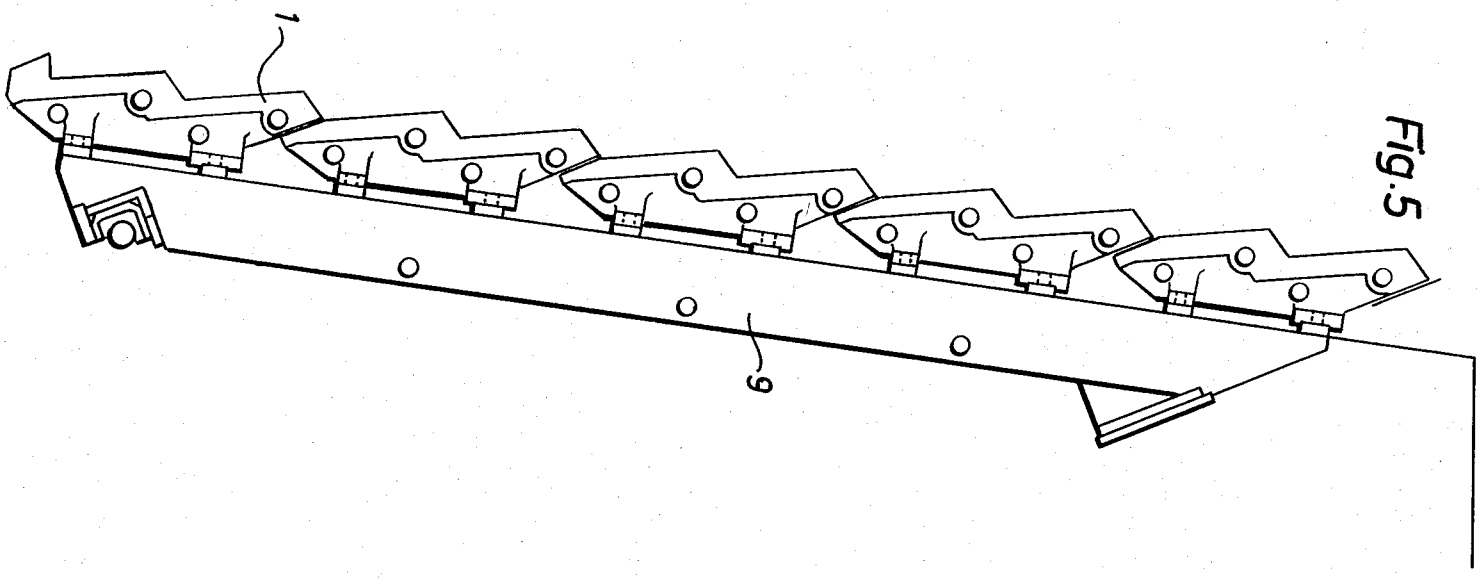
FIG. 5 shows in a corresponding way a vertical section through a row of grate blocks, which are placed on reciprocating grate beams 9.

The half grate blocks at the ends of the stationary rows of grate blocks can be formed in quite a simple manner by shortening the side boards belonging to the whole blocks, and then the space between the side boards can be filled by means of the one row, namely the rearmost, of the two rows of grate bars, which are used to fill the space between the two side boards at the whole grate blocks.

I claim:

1. In a stepped grate for conveying garbage in a direction of travel in an incinerator plant and comprising one or more stepped grates in succession inclined forwardly in said direction of travel, each said grate comprising a plurality of grate blocks placed in a plurality of laterally adjacent stepped rows oriented in parallel with said direction of travel, said grate blocks being suppoted upon parallel placed grate beams in said direction of travel, where every other said row of grate blocks is movable reciprocally in parallel with said direction of travel whereas rows of grate blocks intermediate said every other reciprocally movable row of grate blocks are stationary, wherein the laterally adjacent grate blocks of said movable and stationary rows are placed in staggered position in said direction of travel a distance corresponding to half a grate block length and wherein alternate rows of grate blocks terminate with half grate blocks, whereby colliding contact between said laterally adjacent grate blocks is avoided during said reciprocal movement.

2. The improved stepped grate according to claim 1, wherein said intermediate stationary rows of grate blocks terminate with half grate blocks.

3. An incinerator plant having an improved stepped grate in accordance with claim 1.

* * * * *